United States Patent [19]

Otto

[11] 3,945,533

[45] Mar. 23, 1976

[54] ONE SHOT METERING GUN

[75] Inventor: Mark O. Otto, Wixom, Mich.

[73] Assignee: Graco Inc., Minneapolis, Minn.

[22] Filed: June 2, 1975

[21] Appl. No.: 582,638

[52] U.S. Cl. ..... 222/70; 222/334; 239/70; 239/322; 239/526; 239/569

[51] Int. Cl.[2] ..... B05B 9/00; B67D 5/18

[58] Field of Search ..... 239/70, 569, 526, 322; 222/70, 334

[56] References Cited

UNITED STATES PATENTS

| | | | |
|---|---|---|---|
| 1,704,374 | 3/1929 | Stewart et al. | 239/70 X |
| 2,564,896 | 8/1951 | Justafsson et al. | 239/526 X |
| 2,779,627 | 1/1957 | Gray | 222/334 X |
| 3,160,331 | 12/1964 | Trumbull et al. | 222/309 |
| 3,187,956 | 6/1965 | Dawson | 222/185 |
| 3,292,867 | 12/1966 | Hunter | 239/322 |
| 3,295,371 | 1/1967 | Smith | 222/334 X |

*Primary Examiner*—Robert S. Ward, Jr.
*Attorney, Agent, or Firm*—Paul L. Sjoquist

[57] ABSTRACT

Apparatus for metering a predetermined timed volume of fluidic material through a dispensing circuit upon activation of a trigger, where the trigger actuates an air valve which is connected to a second time-controlled air valve. The second air valve delivers a predetermined timed shot of pressurized air to an air cylinder which is mechanically coupled to the fluidic material dispensing circuit.

7 Claims, 3 Drawing Figures

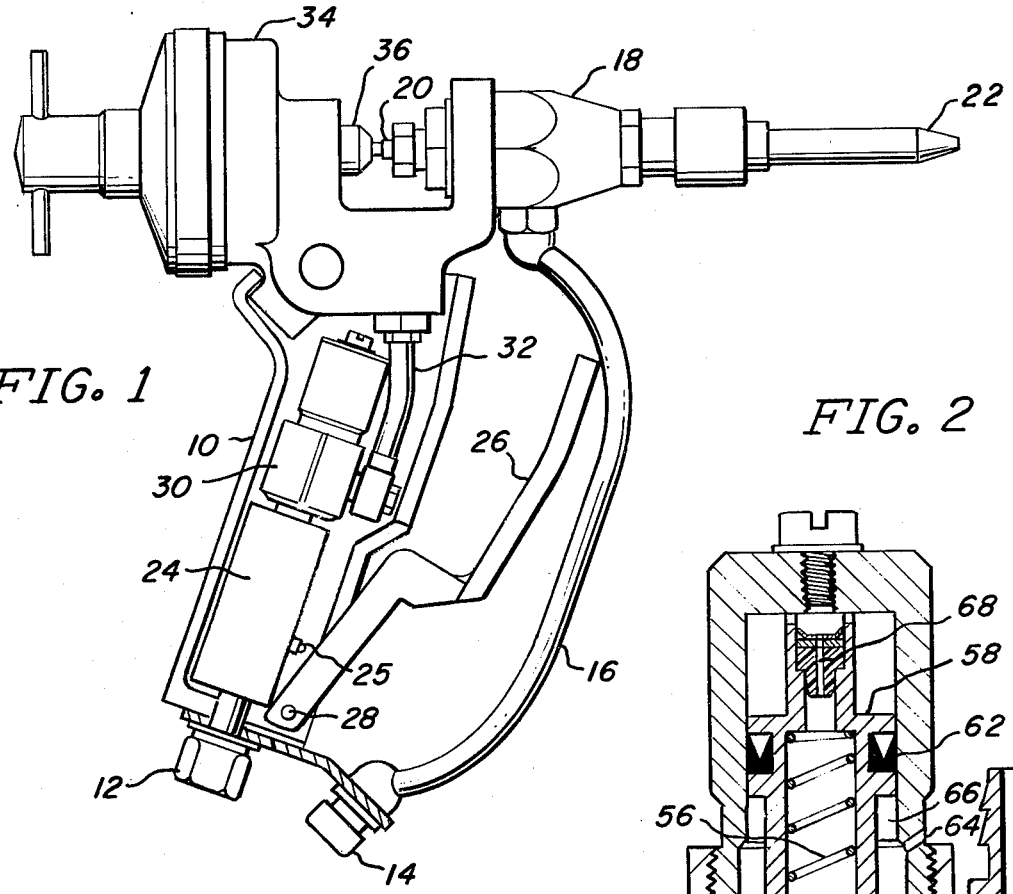
FIG. 1
FIG. 2
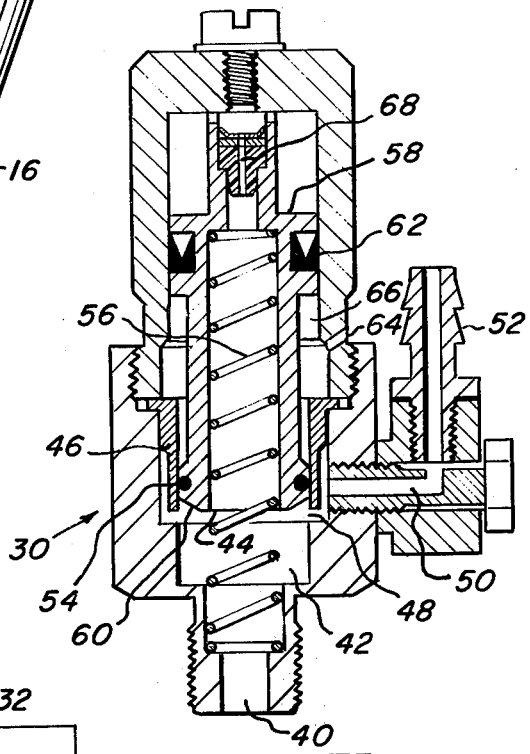
FIG. 3
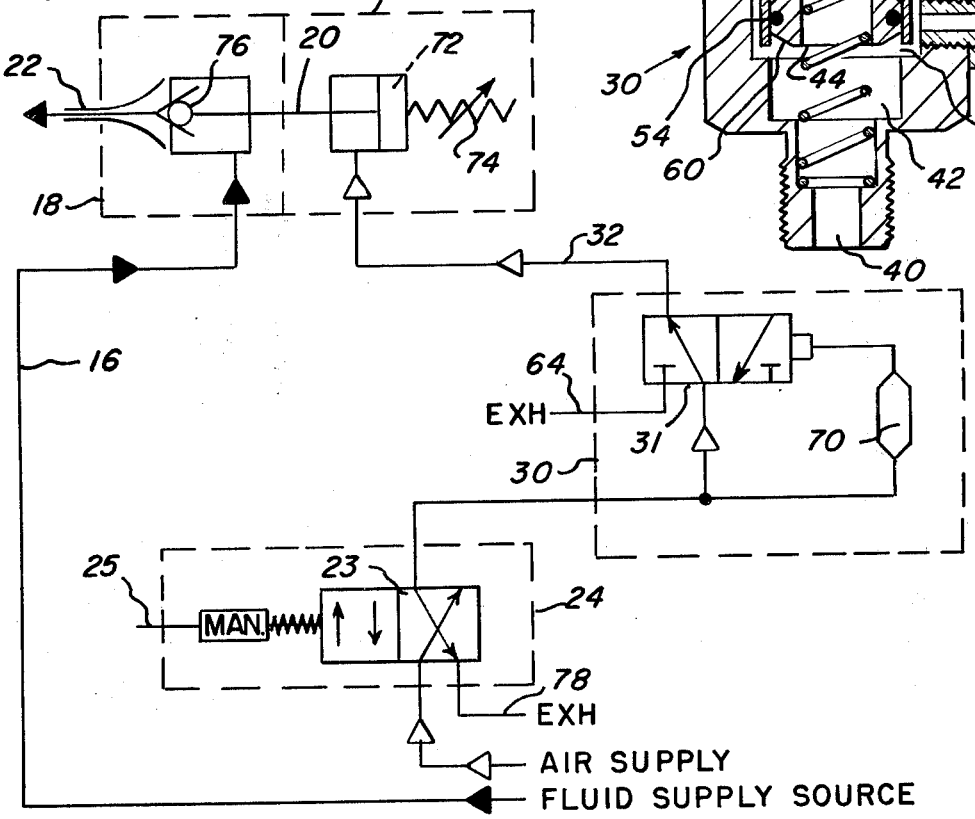

ONE SHOT METERING GUN

BACKGROUND OF THE INVENTION

This invention relates to an apparatus for applying fluidic material, and more specifically to an apparatus for applying a predetermined quantity of fluidic material.

In industrial manufacturing plants a great many repetitive assembly operations require the application of fluidic material such as grease, adhesive, sealants, and other relatively high density and high viscosity material. These operations usually require a relatively small volume shot of material, but it is important that such material be repeatably dispensed, frequently in places which are difficult of access. Cost efficiency in manufacturing operations also requires that excess material applications be kept under strict control, and the quality of the manufacturing process requires that materials be uniformly and consistently applied with highly accurate repeatability so that product quality can be kept uniform.

For example, an automobile manufacturing plant has hundreds of assembly operations which require the application of glue or RTV silicones on parts to hold them together. Small quantities of grease and other lubricants are required to be applied to areas where moving parts contact one another, and sealers, sound deadening insulation, and adhesives are used in considerable quantity. Each of these many fluidic materials are applied to the product as it moves down an assembly line in sequential and repeatable fashion. The cost and quality of the final product is determined in part by the extent to which these material applications can be tightly controlled. Material applications such as described above are typically metered in the 0–2 fluid ounce range by a hand-held gun applicator device. Because a great number of such operations may be performed in any given time period, it is desirable that the gun triggering mechanism be actuated with minimal force. Since the fluidic materials dispensed by such apparatus are usually of high viscosity, a pneumatic piston valve is usually used in conjunction with the trigger to provide an assist to the trigger valving force necessary for opening and closing the fluidic material valve. The fluidic material is typically delivered to the applicator gun in a pressurized hose, and the pressurized air supply used to operate the gun triggering mechanism is delivered in a second pressurized hose. The trigger mechanism opens an air valve which actuates an air piston assembly connected to the fluidic material valve. This opens the fluidic material valve and enables the pressurized fluidic material to pass through the applicator gun and onto the product part. When the trigger is released, the air supply to the air actuated piston is removed and a return spring generally closes the air piston and fluidic material actuator valve. The flow of fluidic material through the applicator gun then ceases.

SUMMARY OF THE INVENTION

The present invention comprises an applicator gun having a trigger for actuating an air cylinder which in turn controls a fluidic material valve for release of fluidic material through the gun. The trigger opens an air valve into an air impulse valve which immediately opens upon receiving an air impulse from the trigger air valve, but remains open only for a predetermined time necessary to develop a closing pressure force, whereupon it closes its output port. Connected to the air impulse valve output port is an air cylinder which opens upon application of the trigger and closes after the predetermined air impulse time has elapsed. The air cylinder is mechanically coupled to a fluidic material valve to open it and allow fluidic material to pass through the gun for the same predetermined time set by the air impulse valve. Thus, if the gun trigger is depressed and held, only a predetermined timed volume of fluidic material will be ejected from the gun before it automatically shuts off. The gun cannot be again actuated until the trigger is first released and then depressed.

DESCRIPTION OF THE DRAWINGS

A preferred embodiment of the present invention is illustrated in the attached drawings, in which:

FIG. 1 illustrates the invention in side view and partial cross section;

FIG. 2 illustrates the air impulse valve construction; and

FIG. 3 is a diagram of the air and fluid circuits utilized by the invention.

DESCRIPTION OF THE PREFERRED EMBODIMENT

Referring first to FIG. 1, the apparatus is shown in side view and in partial cross section. The gun handle 10 has an air connector 12 and a fluidic material connector 14 attached at its base. Fluidic material passes into connector 14 and through pipe 16 into a chamber 18. Chamber 18 is normally blocked by a fluidic material valve which may be retracted via valve stem 20. When valve stem 20 is retracted, the fluidic material valve opens and fluid is ejected from orifice 22.

Air connector 12 is coupled into an air valve 24 which may be actuated by a spring loaded tab 25. Tab 25 contacts trigger 26 which is pivotal about pin 28. When trigger 26 is depressed, it forces tab 25 inwardly and opens an air flow path through air valve 24 into impulse air valve 30. Impulse air valve 30 opens to pass air through conduit 32 for a predetermined time, and then automatically closes. Air flow through conduit 32 passes into air cylinder valve 34 to actuate an internal piston which is mechanically coupled via rod 36 to valve stem 20, A spring return internally biased against air piston closes cylinder valve 34 upon cessation of air flow through conduit 32.

FIG. 2 shows air impulse valve 30 in side view and cross section. An inlet 40 is threadably coupled to air valve 24. Inlet 40 opens into a cylindrical space having a slidable piston 44 therein. Piston 44 slides over the internal surface of cylinder 42, and also over an internal cylindrical sleeve 46 which has its lower edge spaced away from adjacent contact with cylinder 42 to create a passage 48 therebetween. Passage 48 communicates with an outlet passage 50 which passes through a connector 52 for coupling with conduit 32. Piston 44 has an O-ring 54 around its outer circumference to provide a sealable contact between the piston and sleeve 46 and cylinder 42. A compression spring 56, seated between the bottom end of cylinder 42 and the top interior surface of piston 44, exerts an upward force against piston 44 which tends to open inlet 40 to passage 48. This upward spring force is opposed by the force of air pressure acting over the top surface 58 of piston 44, and is aided by the force of air pressure acting over bottom annular surface 60 of piston 44. The cross-sectional area of top surface 58 is greater than the cross-sectional area of annular surface 60, so that for equalized air pressure within valve 30 the net force upon piston 44 is downwardly. A second seal ring 62 is located near the upper end of piston 44, and the region 66 beneath this upper section of piston 44 is vented to the atmosphere via passage 64. Thus, the annular region 66 beneath the top portion of piston 44 is always maintained at atmospheric pressure so that any air pressure on top surface 58 will create a net downward force, if the air pressure on top surface 58 exceeds atmospheric pressure, and also exceeds the force of compression spring 56. An orifice 68 of precise and predetermined diameter is drilled through the top surface of piston 44 to create a communication path for air flow therebetween. Thus, although initially air pressure received at inlet 40 causes piston 44 to move upwardly and thereby exposes passage 48 and 50 to inlet 40, gradually the inlet air leaks through orifice 68 to fill the region above top surface 58. This pressure develops to a point where the force caused thereby is greater than the combined force of air pressure on annular bottom surface 60 and compression spring 56. When this excess pressure differential occurs, piston 44 is forced downwardly to close off passage 48. Once this occurs, the air pressure at inlet 40 must be removed before piston 44 can again be moved upwardly. Once the air pressure at inlet 40 is removed, the excess pressure acting on top surface 58 gradually leaks back through orifice 68 to bleed down to a valve whereby compression spring 56 can exert sufficient upward force to again slide piston 44 upwardly. After this has occurred, the gun trigger may again be depressed to cause the valve 30 to actuate. The overall operation of this valve is to cause piston 44 to initially move upwardly, remain in an upward position for a predetermined time as measured by the size of orifice 68, and then to move downwardly to block the flow therethrough.

FIG. 3 shows a schematic diagram of the air and fluid supply circuits. The air supply is coupled into air valve 24 which is actuated upon depressing tab 25. This causes a spool 23, or other similar air control device, to shift into a flow through conductive position wherein the air supply passes through valve 24 to impulse air valve 30. The flow of air through air impulse valve 30 is also symbolically shown in FIG. 3. Initially, air directly flows through valve 30 via spool 31 to conduit 32. This air arrives at air cylinder 34 where it causes piston 72 to move rearwardly against the force of adjustable spring 74. This retracts valve stem 20 and causes fluidic valve 76 to open. The fluidic material supplied via pipe 62 is then permitted to be ejected from orifice 22.

After a predetermined time, as set by time delay 70, spool 31 moves to close off the flow path through valve 30. The air pressure developed in conduit 32 is then bled backward through valve 30 to discharge through the atmosphere via passage 64, thus relieving the air pressure force against piston 72. Spring 74 causes piston 72 to thereby move forwardly to again close off fluidic valve 76. The operation of the air circuit remains in this stable condition until such time as trigger 26 is released. When this happens, tab 25 causes spool 23 to move leftward to thereby relieve the air pressure from time delay 70 and valve 30 via exhaust 78. The cycle again repeats when the trigger is next depressed to provide a timed shot of fluidic material for each consecutive trigger activation and release.

In operation, the apparatus is connected to a suitable pressurized fluidic supply source and also to a suitable compressed air source. When an application of fluidic material is desired, orifice 22 is placed adjacent the desired location and the trigger is squeezed. A timed volume of fluidic material is ejected from orifice 22 and the flow immediately ceases. The gun may then be removed from the application area and the trigger released at any convenient time, for the next successive timed application of fluidic material cannot be made until after the gun trigger has been released.

Modifications and adaptations may be made to the specific internal valving features of this apparatus, to accomplish the novel and timed valving ejection feature. The preferred embodiment described herein provides an adequate metering feature for the application of most commonly used fluidic materials, and also serves as a useful portable applicator tool.

What is claimed is:

1. An application gun for applying pressurized fluidic material under trigger control with timed volumetric repeatability, comprising:

a. a fluidic material dispensing circuit having an actuable valve therein, connected to said gun;

b. an air cylinder having a piston connected to said actuable valve;

c. an air piston valve having an outlet port connected to said air cylinder and having an inlet port for receiving pressurized air, said air piston valve being characterized by a first open valve position responsive to pressurized air at said inlet port, and a second overriding closed valve position responsive to a predetermined time presence of pressurized air at said inlet port; and d. an air valve having an outlet connected to said air piston valve inlet port and having an inlet for receiving pressurized air, said air valve having an actuable connection to said gun trigger.

2. The apparatus as claimed in claim 1, wherein said air piston valve further comprises an exhaust port connection to its outlet port when said valve is in its second closed valve position.

3. The apparatus as claimed in claim 2, further comprising a return spring in said air cylinder and biased against said piston in force opposition to pressurized air acting upon said piston.

4. The apparatus of claim 3, further comprising means for adjusting the biasing force of said return spring.

5. The apparatus of claim 4, wherein said air piston valve further comprises a piston having a first predetermined area in communication with said inlet port and having a second a larger predetermined area in pressure opposition to said first area, and having a predetermined sized orifice opening between said areas.

6. The apparatus of claim 5, wherein said fluidic material dispensing circuit further comprises an outlet dispensing orifice.

7. Apparatus for applying fluidic material under trigger control with timed volumetric repeatability, comprising:

a. A gun-shaped housing having an inlet for accepting pressurized air and an inlet for accepting fluidic material, and having a fluidic material outlet;

b. an actuable valve in said housing, one side of said valve being in communication with said fluidic material outlet, and the other side of said valve being in communication with said inlet for accepting fluidic material;

c. an air valve in said housing having an inlet coupled to said inlet for accepting pressurized air, and having an outlet, and connected in actuable contact with said trigger d. a first piston valve having a first piston surface area in communication with said air valve outlet, and having an orifice of predetermined size in said first piston area and through said piston to a second piston area in force opposition to said first area, wherein said second area is greater than said first area, said piston valve being slidable to uncover an outlet port;

e. a second piston valve in communication with said outlet port, and having a slidable piston responsive to pressurized air in said outlet port, said piston being connected to said actuable valve in said housing.

* * * * *